US010923103B2

(12) United States Patent
Agiomyrgiannakis

(10) Patent No.: US 10,923,103 B2
(45) Date of Patent: Feb. 16, 2021

(54) SPEECH SYNTHESIS UNIT SELECTION

(71) Applicant: Google LLC, Mountain View, CA (US)

(72) Inventor: Ioannis Agiomyrgiannakis, London (GB)

(73) Assignee: Google LLC, Mountain View, CA (US)

( * ) Notice: Subject to any disclaimer, the term of this patent is extended or adjusted under 35 U.S.C. 154(b) by 84 days.

(21) Appl. No.: 15/824,122

(22) Filed: Nov. 28, 2017

(65) Prior Publication Data

US 2018/0268807 A1 Sep. 20, 2018

Related U.S. Application Data

(63) Continuation of application No. PCT/GR2017/000012, filed on Mar. 14, 2017.

(51) Int. Cl.
*G10L 13/07* (2013.01)
*G10L 13/08* (2013.01)
(Continued)

(52) U.S. Cl.
CPC ..... *G10L 13/07* (2013.01); *G10L 13/047* (2013.01); *G10L 13/06* (2013.01); *G10L 13/08* (2013.01)

(58) Field of Classification Search
CPC ..... G10L 13/07; G10L 13/08
(Continued)

(56) References Cited

U.S. PATENT DOCUMENTS 6,366,883 B1 4/2002 Campbell et al.
7,082,396 B1 * 7/2006 Beutnagel ..... G10L 13/07 704/258
(Continued)

FOREIGN PATENT DOCUMENTS

EP 1589524 10/2005
WO WO 2002/097794 12/2002

OTHER PUBLICATIONS

Hunt, Andrew J., and Alan W. Black. "Unit selection in a concatenative speech synthesis system using a large speech database." 1996 IEEE International Conference on Acoustics, Speech, and Signal Processing Conference Proceedings. vol. 1. IEEE, 1996. (Year: 1996).*
Bulyko et al. "Unit Selection for e Synthesis Using Splicing Costs with Weighted Finite State Transducers," Interspeech, 2001, 4 pages.
Chalamandaris et al. "The ILSP/INNOETICS Text-to-Speech System for the Blizzard Challenge 2014," Blizzard Challenge Workshop, 2014, 5 pages.
(Continued)

*Primary Examiner* — Shaun Roberts
(74) *Attorney, Agent, or Firm* — Honigman LLP; Brett A. Krueger; Grant Griffith

(57) ABSTRACT

Methods, systems, and apparatus, including computer programs encoded on computer storage media, for selecting units for speech synthesis. One of the methods includes determining a sequence of text units that each represent a respective portion of text for speech synthesis; and determining multiple paths of speech units that each represent the sequence of text units by selecting a first speech unit that includes speech synthesis data representing a first text unit; selecting multiple second speech units including speech synthesis data representing a second text unit based on (i) a join cost to concatenate the second speech unit with a first speech unit and (ii) a target cost indicating a degree that the second speech unit corresponds to the second text unit; and defining paths from the selected first speech unit to each of the multiple second speech units to include in the multiple paths of speech units.

15 Claims, 4 Drawing Sheets

(51) Int. Cl.
*G10L 13/06* (2013.01)
*G10L 13/047* (2013.01)

(58) Field of Classification Search
USPC ..... 704/258
See application file for complete search history.

(56) References Cited

U.S. PATENT DOCUMENTS

| | | | | |
|---|---|---|---|---|
| 8,321,222 | B2 | 11/2012 | Pollet et al. | |
| 8,571,871 | B1 * | 10/2013 | Stuttle | G10L 13/033 704/260 |
| 8,731,931 | B2 | 5/2014 | Conkie | |
| 8,751,236 | B1 * | 6/2014 | Fructuoso | G10L 13/06 704/258 |
| 9,240,178 | B1 | 1/2016 | Nadolski et al. | |
| 9,978,359 | B1 * | 5/2018 | Kaszczuk | G10L 13/02 |
| 10,276,147 | B2 * | 4/2019 | Yoo | B60R 13/08 |
| 2009/0043585 | A1 | 2/2009 | Conkie | |
| 2009/0083036 | A1 * | 3/2009 | Zhao | G10L 13/10 704/260 |
| 2011/0071836 | A1 | 3/2011 | Conkie et al. | |
| 2014/0257818 | A1 | 9/2014 | Conkie | |
| 2017/0092259 | A1 * | 3/2017 | Jeon | G10L 13/07 |

OTHER PUBLICATIONS

Chalamandaris et al. "The ILSP/INNOETICS Text-to-Speech System for the Blizzard Challenge 2013," Blizzard Challenge Workshop, 2013, 8 pages.
Chen et al. "The USTC System for Blizzard Challenge 2013," Blizzard Challenge Workshop, 2013, 6 pages.
Colotte et al. "Linguistic features weighting for a Text-to-Speech system without prosody model," Interspeech, Jun. 2005, 4 pages.
Conkie et al. "Improving Preselection in Unit Selection Synthesis," Interspeech, Sep. 2008, 4 pages.
Guennec et al. "Unit Selection Cost Function Exploration Using an A * based Text-to-Speech System," International Conference on Text, Speech, and Dialogue, Springer, Cham, Sep. 2014, 9 pages.
Hart et al. "A Formal Basis for the Heuristic Determination of Minimum Cost Paths," IEEE Transaction of Systems Science and Cybernetics, vol. 4(2) Jul. 1968, 8 pages.
Hunt et al. "Unit Selection in a Concatenative Speech Synthesis System Using a Large Speech Database," International Conference on Acoustics, Speech and Signal Processing, May 1996, 4 pages.
Jiang et al. "The USTC System for Blizzard Challenge 2010," Blizzard Challenge Workshop, 2010 6 pages.
Karabetsos et al. "Embedded Unit Selection Text-To-Speech Synthesis for Mobile Devices," IEEE Transactions on Consumer Electronics 55(2), May 2009, 9 pages.
King. "Measuring a decade of progress in Text-to-Speech," Loquens 1(1), Jun. 2014, 12 pages.
Ling et al. "The USTC and iFlytek Speech Synthesis Systems for Blizzard Challenge 2007," Blizzard Challenge Workshop, Aug. 2007, 6 pages.
Ling et al. "The USTC System for Blizzard Challenge 2012," Blizzard Challenge Workshop, 2012, 5 pages.
Muja et al. "Scalable Nearest Neighbor Algorithms for High Dimensional Data," IEEE Transactions on Pattern Analysis and Machine Intelligence, vol. 36, 2014, 14 pages.
Vepa. "Join Cost for Unit Selection Speech Synthesis," Thesis submitted for the degree of Doctor of Philosophy, University of Edinburgh, Jan. 2004, 241 pages.
EP Extended European Search Report issued in European Application No. 18160557.7, dated Jul. 5, 2018, 8 pages.
Office Action issued in British Application No. GB1717986.2, dated Apr. 27, 2018, 6 pages.

* cited by examiner

SPEECH SYNTHESIS UNIT SELECTION

CROSS-REFERENCE TO RELATED APPLICATION

This application is a Bypass Continuation of International Application No. PCT/GR2017/000012, filed Mar. 14, 2017, the contents of which are incorporated by reference herein.

BACKGROUND

A text-to-speech system may synthesize text data for audible presentation to a user. For instance, the text-to-speech system may receive an instruction indicating that the text-to-speech system should generate synthesis data for a text message or an email. The text-to-speech system may provide the synthesis data to a speaker to cause an audible presentation of the content from the text message or email to a user.

SUMMARY

In some implementations, a text-to-speech system synthesizes audio data using a unit selection process. The text-to-speech system can determine a sequence of speech units and concatenate the speech units to form synthesized audio data. As part of the unit selection process, the text-to-speech system creates a lattice that includes multiple candidate speech units for each phonetic element to be synthesized. Creating the lattice involves processing to select the candidate speech units for the lattice from a large corpus of speech units. To determine which candidate speech units to include in the lattice, the text-to-speech system can use both a target cost and a join cost. Generally, the target cost indicates how accurately a particular speech unit represents the phonetic unit to be synthesized. The join cost can indicate how well the acoustic characteristics of the particular speech unit fit one or more other speech units represented in the lattice. By using a join cost to select the candidate speech units for the lattice, the text-to-speech system can generate a lattice that includes paths representing more natural sounding synthesized speech.

The text-to-speech system may select speech units to include in a lattice using a distance between speech units, acoustic parameters for other speech units in a currently selected path, a target cost, or a combination of two or more of these. For instance, the text-to-speech system may determine acoustic parameters one or more speech units in a currently selected path. The text-to-speech system may use the determined acoustic parameters and acoustic parameters for a candidate speech unit to determine a join cost, e.g., using a distance function, to add the candidate speech unit to the currently selected path of the one or more speech units. In some examples, the text-to-speech system may determine a target cost of adding the candidate speech unit to the currently selected path using linguistic parameters. The text-to-speech system may determine linguistic parameters of a text unit for which the candidate speech unit includes speech synthesis data and may determine linguistic parameters of the candidate speech unit. The text-to-speech system may determine a distance between the text unit and the candidate speech unit, as a target cost, using the linguistic parameters. The text-to-speech system may use any appropriate distance function between acoustic parameter vectors or linguistic parameter vectors that represent speech units. Some examples of distance functions include probabilistic, mean-squared error, and Lp-norm functions.

The text-to-speech system may determine a total cost of a path, e.g., the currently selected path and other paths with different speech units, as a combination of the costs for the speech units in the respective path. The text-to-speech system may compare the total costs of multiple different paths to determine a path with an optimal cost, e.g., a lowest cost or a highest cost total path. In some examples, the total costs may be the join costs or a combination of the join costs and the target cost. The text-to-speech system may select the path with the optimal cost and use the units from the optimal cost path to generate synthesized speech. The text-to-speech system may provide the synthesized speech for output, e.g., by providing data for the synthesized speech to a user device or presenting the synthesized speech on a speaker.

The text-to-speech system may have a very large corpus of speech units that can be used for speech synthesis. A very large corpus of speech units may include data for more than thirty hours of speech units or, in some implementations, data for more than hundreds of hours of speech units. Some examples of speech units include diphones, phones, any type of linguistic atoms, e.g., words, audio chunks, or a combination of two or more of these. The linguistic atoms, the audio chunks, or both, may be of fixed or variable size. One example of a fixed size audio chunk is a five millisecond audio frame.

In general, one innovative aspect of the subject matter described in this specification can be embodied in methods that include the actions of receiving, by one or more computers of a text-to-speech system, data indicating text for speech synthesis; determining, by the one or more computers of the text-to-speech system, a sequence of text units that each represent a respective portion of the text, the sequence of text units including at least a first text unit followed by a second text unit; determining, by the one or more computers of the text-to-speech system, multiple paths of speech units that each represent the sequence of text units, wherein determining the multiple paths of speech units includes: selecting, from a speech unit corpus, a first speech unit that includes speech synthesis data representing the first text unit; selecting, from the speech unit corpus, multiple second speech units including speech synthesis data representing the second text unit, each of the multiple second speech units being determined based on (i) a join cost to concatenate the second speech unit with a first speech unit and (ii) a target cost indicating a degree that the second speech unit corresponds to the second text unit; and defining paths from the selected first speech unit to each of the multiple second speech units to include in the multiple paths of speech units; and providing, by the one or more computers of the text-to-speech system, synthesized speech data according to a path selected from among the multiple paths. Other embodiments of this aspect include corresponding computer systems, apparatus, and computer programs recorded on one or more computer storage devices, each configured to perform the actions of the methods. A system of one or more computers can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions.

The foregoing and other embodiments can each optionally include one or more of the following features, alone or in combination. Determining the sequence of text units that each represent a respective portion of the text may include determining the sequence of text units that each represent a distinct portion of the text, separate from the portions of text represented by the other text units. Providing the synthesized speech data according to the path selected from among the multiple paths may include providing the synthesized speech data to cause a device to generate audible data for the text.

In some implementations, the method may include selecting, from the speech unit corpus, two or more beginning speech units that each include speech synthesis data representing a beginning text unit in the sequence of text units with a location at a beginning of the text string. Selecting the two or more beginning speech units may include selecting a predetermined quantity of beginning speech units. Determining the multiple paths of speech units that each represent the sequence of text units may include determining the predetermined quantity of paths. The method may include selecting, from the predetermined quantity of paths, the path for which to provide the synthesized speech data. The multiple second speech units may include two or more second speech units. Defining paths from the selected first speech unit to each of the multiple second speech units may include determining, for another first speech unit that includes speech synthesis data representing the first text unit, not to add any additional speech units to a path that includes the other first speech unit. The method may include selecting, for the first text unit, the predetermined quantity of first speech units that each include speech synthesis data representing the first text unit; and selecting, for the second text unit, the predetermined quantity of second speech units that each include speech synthesis data representing the second text unit, each of the predetermined quantity of second speech units being determined based on (i) a join cost to concatenate the second speech unit with a respective first speech unit and (ii) a target cost indicating a degree that the second speech unit corresponds to the second text unit.

In some implementations, the method may include determining, for a second predetermined quantity of second speech units that each include speech synthesis data representing the second unit, (i) a join cost to concatenate the second speech unit with a respective first speech unit and (ii) a target cost indicating a degree that the second speech unit corresponds to the second text unit. The second predetermined quantity may be greater than the predetermined quantity. Selecting the predetermined quantity of second speech units may include selecting the predetermined quantity of second speech units from the second predetermined quantity of second speech units using the determined join costs and the determined target costs. The first text unit may have a first location in the sequence of text units. The second text unit may have a second location in the sequence of text units that is subsequent to the first location without any intervening locations. Selecting, from the speech unit corpus, multiple second speech units may include selecting, from the speech unit corpus, the multiple second speech units using (i) a join cost to concatenate the second speech unit with data for the first speech unit and a corresponding beginning speech unit from the two or more beginning speech units and (ii) the target cost indicating a degree that the second speech unit corresponds to the second text unit. The method may include determining a path that includes a selected speech unit for each of the text units in the sequence of text units up to the first location, wherein the selected speech units include the first speech unit and the corresponding beginning speech unit; determining first acoustic parameters for each of the selected speech units in the path; and determining, for each of the multiple second speech units, the join cost using the first acoustic parameters for each of the selected speech units in the path and second acoustic parameters for the second speech unit. Determining, for each of the multiple second speech units, the join cost may include concurrently determining, for each of two or more second speech units, the join cost using the first acoustic parameters for each of the selected speech units in the path and second acoustic parameters for the second speech unit.

The subject matter described in this specification can be implemented in various embodiments and may result in one or more of the following advantages. In some implementations, a text-to-speech system can overcome local minima or local maxima in determining a path that identifies speech units for speech synthesis of text. In some implementations, determining a path using both a target cost and a join cost together improves the results of a text-to-speech process, e.g., to determine a more easily understandable or more natural sounding text-to-speech result, compared to systems that perform preselection or lattice-building using target cost alone. For example, in some instances, a particular speech unit may match a desired phonetic element well, e.g., have a low target cost, but may fit poorly with other units in a lattice, e.g., have a high join cost. Systems that do not take into account join costs when building a lattice may be overly influenced by the target cost and include the particular unit to the detriment of the overall quality of the utterance. With the techniques disclosed herein, the use of join costs to build the lattice can avoid populating the lattice with speech units that minimize target cost at the expense of overall quality. In other words, the system can balance the contribution of join costs and target costs when selecting each unit to include in the lattice, to add units that may not be the best matches for individual units but work together to produce a better overall quality of synthesis, e.g., a lower overall cost.

In some implementations, the quality of a text-to-speech output can be improved by building a lattice using a join cost that uses acoustic parameters for all speech units in a path through the lattice. Some implementations of the present techniques determine a join cost for adding a current unit after the immediately previous unit. In addition, or as an alternative, some implementations build a lattice using join costs that represent how well an added unit fits multiple units in a path through the lattice. For example, a join cost used to select units for the lattice can take into account the characteristics of an entire path, from a speech unit in the lattice that represents the beginning of the utterance up to the point in the lattice where the new unit is being added. The system can determine whether a unit fits the entire sequence of units, and can use the results of the Viterbi algorithm for the path to select a unit to include in the lattice. In this manner, the selection of units to include in the lattice can be dependent on Viterbi search analysis. In addition, the system can add units to the lattice to continue multiple different paths, which may begin with the same or different units in the lattice. This maintains a diversity of paths through the lattice and can help avoid local minima or local maxima that could adversely affect the quality of synthesis for the utterance as a whole.

In some implementations, the systems and methods described below that generate a lattice with a target cost and a join cost jointly may generate better speech synthesis results than other systems with a large corpus of synthesized speech data, e.g., more than thirty or hundreds of hours of speech data. In many systems, the quality of text-to-speech output saturates as the size of the corpus of speech units increases. Many systems are unable to account for the relationships among the acoustics of speech units during the pre-selection or lattice building phase, and so are unable to take full advantage of the large set of speech units available. With the present techniques, the text-to-speech system can consider the join costs and acoustic properties of speech units as the lattice is being constructed, which allows a more fine-grained selection that builds sequences of units representing more natural sounding speech.

In some implementations, the systems and methods described below can increase the quality of text-to-speech synthesis while limiting computational complexity and other hardware requirements. For example, the text-to-speech system can select a predetermined number of paths that identify sequences of speech units, and set a bound on a total number of paths analyzed at any time and an amount of memory required to store data for those paths. In some implementations, the systems and methods described below recall pre-recorded utterances or parts of utterances from a corpus of speech units to improve synthesized speech generation quality in a constrained text domain. For instance, a text-to-speech system may recall the pre-recorded utterances or parts of utterances to reach maximum quality whenever the text domain is constrained, e.g., in GPS navigation applications.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
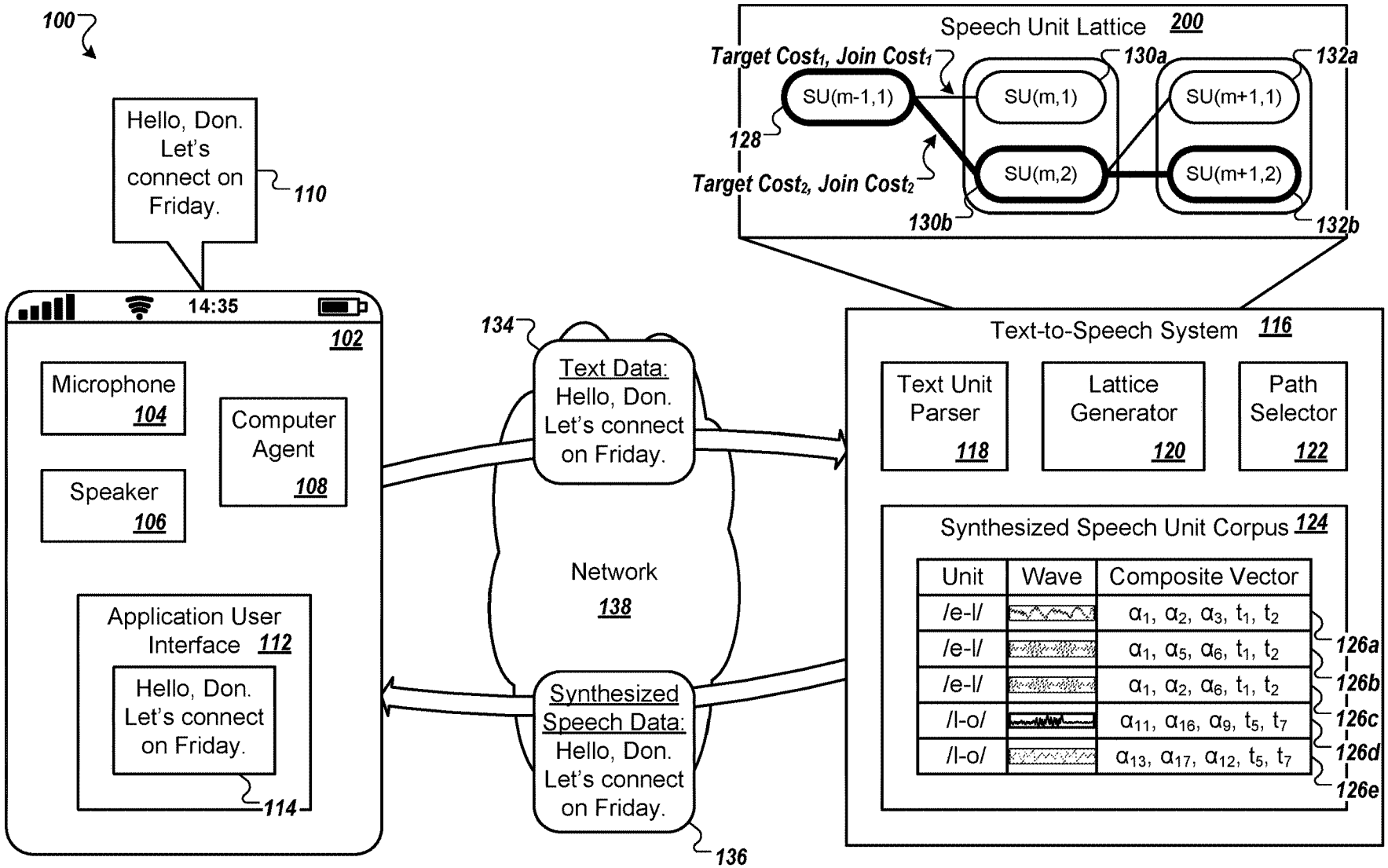
FIG. 1 is an example of an environment in which a user device requests speech synthesis data from a text-to-speech system.

FIG. 1 is an example of an environment 100 in which a user device 102 requests speech synthesis data from a text-to-speech system 116. The user device 102 may request the speech synthesis data so that the user device 102 can generate an audible presentation of text content, such as an email, a text message, a message to be provided by a digital assistant, a communication from an application, or other content. In FIG. 1, the text-to-speech system 116 is separate from the user device 102. In some implementations, the text-to-speech system 116 is included in the user device 102, e.g., implemented on the user device 102.

The user device 102 may determine to present text content audibly, e.g., to a user. For instance, the user device 102 may include a computer-implemented agent 108 that determines to present text content audibly. The computer-implemented agent 108 may prompt a user that "there is an unread text message for you." The computer-implemented agent 108 may provide data to a speaker 106 to cause presentation of the prompt. In response, the computer-implemented agent 108 may receive an audio signal from a microphone 104. The computer-implemented agent 108 analyzes the audio signal to determine one or more utterances included in the audio signal and whether any of those utterances is a command. For example, the computer-implemented agent 108 may determine that the audio signal includes an utterance of "read the text message to me."

The computer-implemented agent 108 retrieves text data, e.g., for the text message, from a memory. For instance, the computer-implemented agent 108 may send a message, to a text message application, that requests the data for the text message. The text message application may retrieve the data for the text message from a memory and provide the data to the computer-implemented agent 108. In some examples, the text message application may provide the computer-implemented agent 108 with an identifier that indicates a memory location at which the data for the text message is stored.

The computer-implemented agent 108 provides the data for the text, e.g., the text message, in a communication 134 to the text-to-speech system 116. For example, the computer-implemented agent 108 retrieves the data for the text "Hello, Don. Let's connect on Friday" from a memory and creates the communication 134 using the retrieved data. The computer-implemented agent 108 provides the communication 134 to the text-to-speech system 116, e.g., using a network 138.

The text-to-speech system 116 provides at least some of the data from the communication 134 to a text unit parser 118. For instance, the text-to-speech system 116 provides data for all of the text for "Hello, Don. Let's connect on Friday" to the text unit parser 118. In some examples, the text-to-speech system 116 may provide data for some, but not all, of the text to the text unit parser 118, e.g., depending on a size of text the text unit parser 118 will analyze.

The text unit parser 118 creates a sequence of text units for text data. The text units may be any appropriate type of text units such as diphones, phones, any type of linguistic atom, e.g., words or audio chunks, or a combination of two or more of these. For example, the text unit parser creates a sequence of text units for the text message. One example of a sequence of text units for the word "hello" includes three text units: "h-e", "e-l", and "l-o".

The sequence of text units may represent a portion of a word, a word, a phrase, e.g., two or more words, a portion of a sentence, a sentence, multiple sentences, a paragraph, or another appropriate size of text. The text unit parser 118, or another component of the text-to-speech system 116, may select the text for the sequence of text units using one or more of a delay for presentation of audible content, a desired likelihood of how well synthesized speech represents naturally articulated speech, or both. For instance, the text-to-speech system 116 may determine a size of text to provide to the text unit parser 118 using a delay for presentation of audible content, e.g., such that smaller sizes of text reduce a delay from the time the computer-implemented agent 108 determines to present audible content to the time the audible content is presented on the speaker 106, and provides the text to the text unit parser 118 to cause the text unit parser 118 to generate a corresponding sequence of text units.

The text unit parser 118 provides the sequence of text units to a lattice generator 120 that selects speech units, which include speech synthesis data representing corresponding text units from a sequence of text units, from a synthesized speech unit corpus 124. For example, the synthesized speech unit corpus 124 may be a database that includes multiple entries 126*a-e* that each include data for a speech unit. The synthesized speech unit corpus 124 may include data for more than thirty hours of speech units. In some examples, the synthesized speech unit corpus 124 may include data for more than hundreds of hours of speech units.

Each of the entries 126*a-e* for a speech unit identifies a text unit to which the entry corresponds. For instance, a first, second, and third entry 126*a-c* may each identify a text unit of "/e-l/" and a fourth and fifth entry 126*d-e* may each identify a text unit of "/l-o/".

Each of the entries 126*a-e* for a speech unit identifies data for a waveform for audible presentation of the respective text unit. A system, e.g., the user device 102, may use the waveform, in combination with other waveforms for other text units, to generate an audible presentation of text, e.g., the text message. An entry may include data for the waveform, e.g., audio data. An entry may include an identifier that indicates a location at which the waveform is stored, e.g., in the text-to-speech system 116 or on another system.

The entries 126*a-e* for speech units include data indicating multiple parameters of the waveform identified by the respective entry. For instance, each of the entries 126*a-e* may include acoustic parameters, linguistic parameters, or both, for the corresponding waveform. The lattice generator 120 uses the parameters for an entry to determine whether to select the entry as a candidate speech unit for a corresponding text unit, as described in more detail below.

Acoustic parameters may represent the sound of the corresponding waveform for the speech unit. In some examples, the acoustic parameters may relate to an actual realization of the waveform, and may be derived from the waveform for the speech unit. For instance, acoustic parameters may convey information about the actual message that is carried in the text, e.g., information about the identity of the spoken phoneme. Acoustic parameters may include pitch, fundamental frequency, spectral information and/or spectral envelope information that may be parameterized in representations such as mel-frequency coefficients, intonation, duration, speech unit context, or a combination of two or more of these. A speech unit context may indicate other speech units that were adjacent to, e.g., before or after or both, the waveform when the waveform was created. The acoustic parameters may represent an emotion expressed in the waveform, e.g., happy, not happy, sad, not sad, unhappy, or a combination of two or more of these. The acoustic parameters may represent a stress included in the waveform, e.g., stressed, not stressed, or both. The acoustic parameters may indicate a speed at which the speech included in a waveform was spoken. The lattice generator 120 may select multiple speech units with the same or a similar speed to correspond to the text units in a sequence of text units, e.g., so that the synthesized speech is more natural. The acoustic parameters may indicate whether the waveform includes emphasis. In some examples, the acoustic parameters may indicate whether the waveform is appropriate to synthesize text that is a question. For example, the lattice generator 120 may determine that a sequence of text units represent a question, e.g., for a user of the user device 102, and select a speech unit from the synthesized speech unit corpus 124 with acoustic parameters that indicate that the speech unit has an appropriate intonation for synthesizing an audible question, e.g., a rising inflection. The acoustic parameters may indicate whether the waveform is appropriate to synthesize text that is an exclamation.

Linguistic parameters may represent data derived from text to which a unit, e.g., a text unit or a speech unit, corresponds. The corresponding text may be a word, phrase, sentence, paragraph, or part of a word. In some examples, a system may derive linguistic parameters from the text that was spoken to create the waveform for the speech unit. In some implementations, a system may determine linguistic parameters for text by inference. For instance, a system may derive linguistic parameters for a speech unit from a phoneme or Hidden Markov model representation of text that includes the speech unit. In some examples, a system may derive linguistic parameters for a speech unit using a neural network, e.g., using a supervised, semi-supervised or unsupervised process. Linguistic parameters may include stress, prosody, whether a text unit is part of a question, whether a text unit is part of an exclamation, or a combination of two or more of these. In some examples, some parameters may be both acoustic parameters and linguistic parameters, such as stress, whether a text unit is part of a question, whether a text unit is part of an exclamation, or two or more of these.

In some implementations, a system may determine one or more acoustic parameters, one or more linguistic parameters, or a combination of both, for a waveform and corresponding speech unit using data from a waveform analysis system, e.g., an artificial intelligence waveform analysis system, using user input, or both. For instance, an audio signal may have a flag indicating that the content encoded in the audio signal is "happy." The system may create multiple waveforms for different text units in the audio signal, e.g., by segmenting the audio signal into the multiple waveforms, and associate each of the speech units for the waveforms with a parameter that indicates that the speech unit includes synthesized speech with a happy tone.

The lattice generator 120 creates a speech unit lattice 200, described in more detail below, by selecting multiple speech units for each text unit in the sequence of text units using a join cost, a target cost, or both, for each of the multiple speech units. For instance, the lattice generator 120 may select a first speech unit that represents the first text unit in the sequence of text units, e.g., "h-e", using a target cost. The lattice generator 120 may select additional speech units, such as a second speech unit that represents a second text unit, e.g., "e-l", and a third speech unit that represents a third text unit, e.g., "l-o", using both a target cost and a join cost for each of the additional speech units.

The speech unit lattice 200 include multiple paths through the speech unit lattice 200 that each include only one speech unit for each corresponding text unit in a sequence of text units. A path identifies a sequence of speech units that represent the sequence of text units. One example path includes the speech units 128, 130*b*, and 132*a* and another example pay includes the speech units 128, 130*b*, and 132*b*.

Each of the speech units identified in the path may correspond to a single text unit at a single location in the sequence of text units. For instance, with the sequence of text units "Hello, Don. Let's connect on Friday", the sequence of text units may include "D-o", "o-n", "l-e", "t-s", "c-o", "n-e", "c-t", and "o-n", among other text units. The lattice generator 120 selects one speech unit for each of these text units. Although the path includes two instances of "o-n"—a first for the word "Don" and a second for the word "on"—the path will identify two speech units, one for each instance of the text unit "o-n". The path may identify the same speech unit for each of the two text units "o-n" or may identify different speech units, e.g., depending on the target cost, the join cost, or both, for speech units that correspond to these text units.

A quantity of speech units in a path is less than or equal to a quantity of text units in the sequence of text units. For instance, when the lattice generator 120 has not completed a path, the path includes fewer speech units than the quantity of text units in the sequence of text units. When the lattice generator 120 has completed a path, that path includes one speech unit for each text unit in the sequence of text units.

A target cost for a speech unit indicates a degree that the speech unit corresponds to a text unit in a sequence of text units, e.g., describes how well the waveform for the speech unit conveys the intended message of the text. The lattice generator 120 may determine a target cost for a speech unit using the linguistic parameters of the candidate speech unit and the linguistic parameters of the target text unit. For instance, a target cost for the third speech unit indicates a degree that the third speech unit corresponds to the third text unit, e.g., "l-o". The lattice generator 120 may determine a target cost as a distance between the linguistic parameters of a candidate speech unit and the linguistic parameters of the target text unit. The lattice generator 120 may use a distance functions such as probabilistic, mean-squared error, or Lp-norm.

A join cost indicates a cost to concatenate a speech unit with one or more other speech units in a path. For instance, a join cost describes how well a waveform, e.g., a synthesized utterance, behaves as naturally articulated speech given the concatenation of the waveform for a speech unit to other waveforms for the other speech units that are in a path. The lattice generator 120 may determine a join cost for a candidate speech unit using the acoustic parameters for the speech unit and acoustic parameters for one or more speech units in the path to which the candidate speech unit is being considered for addition. For example, the join cost for adding the third speech unit 132*b* to a path that includes a first speech unit 128 and a second speech unit 130*b* may represent the cost of combining the third speech unit 132*b* with the second speech unit 130*b*, e.g., how well this combination likely represents naturally articulated speech, or may indicate the cost of combining the third speech unit 132*b* with the combination of the first speech unit 128 and the second speech unit 130*b*. The lattice generator 120 may determine a join cost as a distance between the acoustic parameters of the candidate speech unit and the speech unit or speech units in the path to which the candidate speech unit is being considered for addition. The lattice generator 120 may use a probabilistic, mean-squared error, or Lp-norm distance function.

The lattice generator 120 may determine whether to use a target cost, a join cost, or both, when selecting a speech unit using a type of target data available to the lattice generator 120. For example, when the lattice generator 120 only has linguistic parameters for a target text unit, e.g., for a beginning text unit in a sequence of text units, the lattice generator 120 may determine a target cost to add a speech unit to a path for the sequence of text units. When the lattice generator 120 has both acoustic parameters for a previous speech unit and linguistic parameters for a target text unit, the lattice generator 120 may determine both a target cost and a join cost for adding a candidate speech unit to a path.

When the lattice generator 120 uses both a target cost and a join cost during analysis of whether to add a candidate speech unit 130*a* to a path, the lattice generator 120 may use a composite vector of parameters for the candidate speech unit 130*a* to determine a total cost that is a combination of the target cost and the join cost. For instance, the lattice generator 120 may determine a target composite vector by combining a vector of linguistic parameters for a target text unit, e.g., target(m), with a vector of acoustic parameters for a speech unit 128 in a path to which the candidate speech unit is being considered for addition, e.g., SU(m−1,1). The lattice generator 120 may receive the linguistic parameters for the target text unit from a memory, e.g., a database that includes linguistic parameters for target text units. The lattice generator 120 may receive the acoustic parameters for the speech unit 128 from the synthesized speech unit corpus 124.

The lattice generator 120 may receive a composite vector for the candidate speech unit 130*a*, e.g., SU(m,1) from the synthesized speech unit corpus 124. For example, when the lattice generator 120 receives a composite vector for a first entry 126*a* in the synthesized speech unit corpus 124, the composite vector includes acoustic parameters $\alpha_1$, $\alpha_2$, $\alpha_3$, linguistic parameters $t_1$, $t_2$, among other parameters, for the candidate speech unit 130*a*.

The lattice generator 120 may determine a distance between the target composite vector and the composite vector for the candidate speech unit 130*a* as a total cost for the candidate speech unit. When the candidate speech unit 130*a* is SU(m,1), the total cost for the candidate speech unit SU(m,1) is a combination of $\text{TargetCost}_1$ and $\text{JoinCost}_1$. The target cost may be represented as a single numeric, e.g., decimal, value. The lattice generator 120 may determine $\text{TargetCost}_1$ and $\text{JoinCost}_1$ separately, e.g., in parallel, and then combine the values to determine the total cost. In some examples, the lattice generator 120 may determine the total cost, e.g., without determining either the $\text{TargetCost}_1$ or $\text{JoinCost}_1$.

The lattice generator 120 may determine another candidate speech unit 130*b*, e.g., SU(m,2), to analyze for potential addition to the path including the selected speech unit 128, e.g., SU(m−1,1). The lattice generator 120 may use the same target composite vector for the other candidate speech unit 130*b* because the target text unit and the speech unit 128 in the path to which the other candidate speech unit 130*b* is being considered for addition are the same. The lattice generator 120 may determine a distance between the target composite vector and another composite vector for the other candidate speech unit 130*b* to determine a total cost for adding the other candidate speech unit to the path. When the other candidate speech unit 130*b* is SU(m,2), the total cost for the candidate speech unit SU(m,2) is a combination of $\text{TargetCost}_2$ and $\text{JoinCost}_2$.

In some implementations, a target composite vector may include data for multiple speech units in a path to which the candidate speech unit is being considered for addition. For instance, when the lattice generator 120 determines candidate speech units to add to the path that includes the selected speech unit 128 and the selected other candidate speech unit 130*b*, a new target composite vector may include acoustic parameters for both the selected speech unit 128 and the selected other speech unit 130*b*. The lattice generator 120 may retrieve a composite vector for a new candidate speech unit 132*b* and compare the new target composite vector with the new composite vector to determine a total cost for adding the new candidate speech unit 132*b* to the path.

In some implementations, when a parameter may be an acoustic parameter and a linguistic parameter, an entry 126*a-e* for a speech unit may include a composite vector with data for the parameters that encodes the parameter once. The lattice generator 120 may determine whether to use the parameter in a cost calculation for a speech unit based on the parameters for a target text unit, the acoustic parameters for selected speech units in the path, or both. In some examples, when a parameter may be an acoustic parameter and a linguistic parameter, an entry 126*a-e* for a speech unit may include a composite vector with data for the parameters that encodes the parameter twice, once as a linguistic parameter and once as an acoustic parameter.

In some implementations, particular types of parameters are only linguistic parameters or acoustic parameters and are not both. For instance, when a particular parameter is a linguistic parameter, that particular parameter might not be an acoustic parameter. When a particular parameter is an acoustic parameter, that particular parameter might not be a linguistic parameter.

Figure 2:
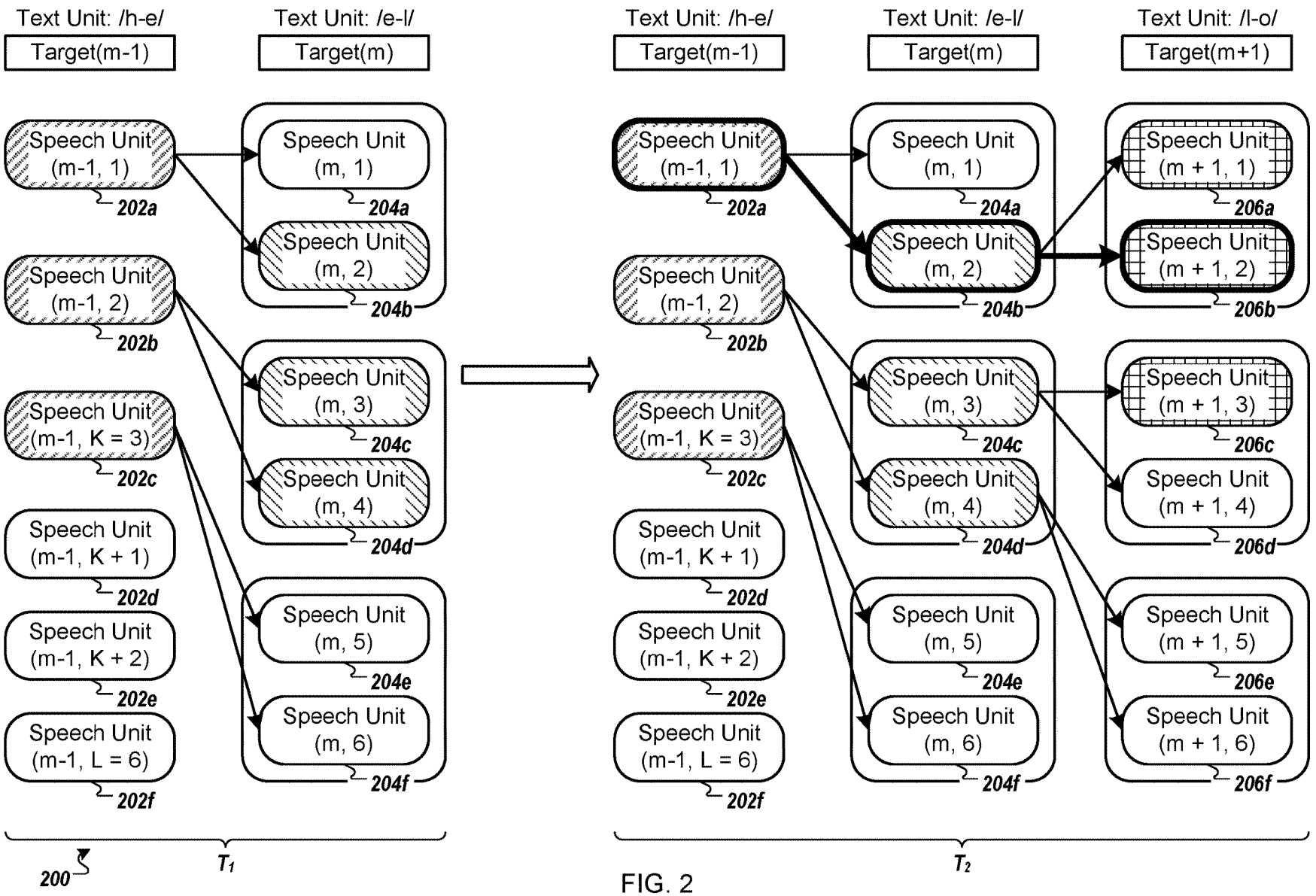
FIG. 2 is an example of a speech unit lattice.

FIG. 2 is an example of a speech unit lattice 200. The lattice generator 120 may sequentially populate the lattice 200 with a predetermined quantity of L speech units for each text unit in the sequence of text units. Each column illustrated in FIG. 2 represents a text unit and corresponding speech units. For each text unit, the lattice generator continues a predetermined number of paths K represented by the speech unit lattice 200. At each text unit, or when populating each column illustrated, the lattice generator 120 re-evaluates which K paths should be continued. After the lattice 200 is constructed, the text-to-speech system 116 can use the speech unit lattice 200 to determine synthesized speech for the sequence of text units. In some examples, the lattice generator 120 may include, in the lattice 200 and for each text unit, a predetermined quantity L of speech units that is greater than the predetermined number K of paths selected to be continued at each transition from one text unit to the next. Additionally, a path identified as one of the best K paths that are identified for a particular text unit can be expanded or branched into two or more paths for the next text unit.

In general, the lattice 200 can be constructed to represent a sequence of M text units, where m represents an individual text unit in the sequence {1, . . . , M}. The lattice generator 120 fills an initial lattice portion or column representing the initial text unit (m=1) in the sequence. This may be done by selecting, from a speech unit corpus, the quantity L of speech units that have the lowest target cost with respect to the m=1 text unit. For each additional text unit in the sequence (m={2, . . . , M}), the lattice generator 120 also fills the corresponding column with L speech units. For these columns, the set of L speech units may be made up of distinct sets of nearest neighbors identified for different paths through the lattice 200. In particular, the lattice generator 120 may identify the best K paths through the lattice 200, and determine a set of nearest neighbors for each of the best K paths. The best K paths can be constrained so that each ends at a different speech unit in the lattice 200, e.g., the best K paths end at K different speech units. The nearest neighbors for a path may be determined using (i) target cost for the current text unit, and (ii) join cost with respect to the last speech unit in the path and/or other speech units in the path. After the set of L speech units has been selected for a given text unit, the lattice generator 120 may runs an iteration of the Viterbi algorithm, or another appropriate algorithm, to identify the K best paths to use when selecting speech units to include in the lattice 200 for the next text unit.

In general, the lattice generator 120 selects multiple candidate speech units to include in the lattice 200 for each text unit, e.g., phone or diphone, of the text to be synthesized, e.g., for each text unit in the sequence of text units. The number of speech units selected for each text unit can be limited to a predetermined number, e.g., the predetermined quantity L.

For instance, the lattice generator 120, prior to time period $T_1$, may select the predetermined quantity L of first speech units 202*a-f* for a first text unit "h-e" in a sequence of text units. The lattice generator 120 may select the L best speech units for the first speech units 202*a-f*. For example, the lattice generator 120 may use a target cost for each of the first speech units 202*a-f* to determine which of the first speech units 202*a-f* to select. If the first unit "h-e" represents the initial text unit at the beginning of an utterance being synthesized, only the target cost with respect to the text unit may be used. If the first unit "h-e" represents the middle of an utterance, such as the second or subsequent word in the utterance, the target cost may be used along with a join cost to determine which speech units to select and include in the lattice 200. The lattice generator 120 selects a predetermined number K of the predetermined quantity L of the first speech units 202*a-f*. The selected predetermined number K of the first speech units 202*a-f*, e.g., the selected first speech units 202*a-c*, are shown in FIG. 2 with cross hashing. In some examples, the lattice generator 120 may determine the predetermined number K of first speech units 202*a-f* to select as the starting speech units for paths that represent the sequence of text units, e.g., with or without selecting the L first speech units 202*a-f*.

When the first text unit represents the initial text unit of the sequence, the lattice generator 120 may select the first speech units 202*a-c* as the predetermined number K of speech units having a best target cost for the first text unit. The best target cost may be the lowest target cost, e.g., when lower values represent a closer match between the respective first speech unit 202*a-f* and the text unit "h-e", e.g., target (m−1). In some examples, the best target cost may be a shortest distance between linguistic parameters for the candidate first speech unit and linguistic parameters for the target text unit. The best target cost may be a highest target cost, e.g., when higher values represent a closer match between the respective first speech unit 202*a-f* and the text unit "h-e". When the lattice generator 120 uses a lowest target cost, lower join costs represent more naturally articulated speech for the target unit. When the lattice generator 120 uses a highest target cost, higher join costs represent more naturally articulated speech for the target unit.

During time $T_1$, the lattice generator 120 determines, for each of the current paths, e.g., for each of the selected first units 202*a-c*, one or more candidate speech units using a join cost, a target cost, or both, for the candidate speech units. The lattice generator 120 may determine the candidate second speech units 204*a-f* from the synthesized speech unit corpus 124. The lattice generator 120 may determine a total of the predetermined quantity L of candidate second speech units 204*a-f*. The lattice generator 120 may determine, for each of the K current paths, a number of candidate speech units using the values of both L and K. The K current paths are indicated in FIG. 2 by the selected first speech units 202*a-c*, shown with cross hatching and the connections between the selected first speech units 202*a-c* are shown with arrows between the selected first speech units 202*a-c* and the candidate second speech units 204*a-f*, e.g., each of the candidate second speech units 204*a-f* is specific to one of the selected first speech units 202*a-c*. For instance, the lattice generator 120 may determine L/K candidate speech units for each of the K paths. As shown in FIG. 2, with K=3 and L=6, the lattice generator 120 may determine a total of two candidate second speech units 204 for each of the current paths identified by the selected first speech units 202*a-c*. The lattice generator 120 may determine two candidate second speech units 204*a-b* for the path that includes the first speech unit 202*a*, two candidate second speech units 204*c-d* for the path that includes the first speech unit 202*b*, and two candidate second speech units 204*e-f* for the path that includes the first speech unit 202*c*.

The lattice generator 120 selects multiple candidate speech units from the candidate second speech units 204*a-f* for addition to the definitions of the K paths and that correspond to the second text unit "e-l", e.g., target(m). The lattice generator 120 may select the multiple candidate speech units from the candidate second speech units 204*a-f* using the join cost, target cost, or both, for the candidate speech units. For example, the lattice generator 120 may select the best K candidate second speech units 204*a-f*, e.g., that have lower or higher costs than the other speech units in the candidate second speech units 204*a-f*. When lower costs represent a closer match with the corresponding selected first speech unit, the lattice generator 120 may select the K candidate second speech units 204*a-f* with the lowest costs. When higher costs represent a closer match with the corresponding selected first speech unit, the lattice generator 120 may select the K candidate second speech units 204*a-f* with the highest costs.

The lattice generator 120 selects the candidate second speech units 204*b-d*, during time period $T_1$, to represent the best K paths to the second text unit "e-l". The selected second speech units 204*b-d* are shown with cross hatching in FIG. 2. The lattice generator 120 adds the candidate second speech unit 204*b*, as a selected second speech unit, to the path that includes the first speech unit 202*a*. The lattice generator 120 adds the candidate second speech units 204*c-d*, as selected second speech units, to the path that includes the first speech unit 202*b* to define two paths. For instance, the first path that includes the first speech unit 202*b* also includes the selected second speech unit 204*c* for the second text unit "e-l". The second path that includes the first speech unit 202*b* includes the selected second speech unit 204*d* for the second text unit "e-l".

In this example, the path that previously included the first speech unit 202*c* is does not include a current speech unit, e.g., is not a current path after time $T_1$. Because the costs for both of the candidate second speech units 204*e-f* were worse than the costs for the selected second speech units 204*b-d*, the lattice generator 120 did not select either of the candidate second speech units 204*e-f* and determines to stop adding speech units to the path that includes the first speech unit 202*c*.

During time period $T_2$, the lattice generator 120 determines, for each of the selected second speech units 204*b-d* that represent the best K paths up to the "e-l" text unit, multiple candidate third speech units 206*a-f* for the text unit "l-o", e.g., target(m+1). The lattice generator 120 may determine the candidate third speech units 206*a-f* from the synthesized speech unit corpus 124. The lattice generator 120 may repeat a process similar to the process used to determine the candidate second speech units 204*a-f* to determine the candidate third speech units 206*a-f*. For example, the lattice generator 120 may determine the candidate third speech units 206*a-b* for the selected second speech unit 204*b*, the candidate third speech units 206*c-d* for the selected second speech unit 204*c*, and the candidate third speech units 206*e-f* for the selected second speech unit 204*d*. The lattice generator 120 may use a target cost, a join cost, or both, e.g., a total cost, to determine the candidate third speech units 206*a-f*.

The lattice generator 120 may then select multiple speech units from the candidate third speech units 206*a-f* using a target cost, a join cost, or both, to add to the speech unit paths. For instance, the lattice generator 120 may select the candidate third speech units 206*a-c* to define paths for the sequence of text units that include speech units for the text unit "l-o." The lattice generator 120 may select the candidate third speech units 206*a-c* to add to the paths because the total costs for these speech units is better than the total costs for the other candidate third speech units 206*d-f*.

The lattice generator 120 may continue the process of selecting multiple speech units for each text unit using join costs, target costs, or both, for all of the text units in sequence of text units. For example, the sequence of text units may include "h-e", "e-l", and "l-o" at the beginning of the sequence, as described with reference to FIG. 1, in the middle of the sequence, e.g., "Don—hello . . . ", or at the end of the sequence.

In some implementations, the lattice generator 120 may determine a target cost, a join cost, or both, for one or more candidate speech units with respect to a non-selected speech unit. For instance, the lattice generator 120 may determine costs for the candidate second speech units 204*a-f* with respect to the non-selected first speech units 202*d-f*. If the lattice generator 120 determines that a total path cost for a combination of one of the candidate second speech units 204*a-f* with one of the non-selected first speech units 202*d-f* indicates that this path is one of the best K paths, the lattice generator 120 may add the respective second speech unit to the non-selected first speech unit. For instance, the lattice generator may determine that a total path cost for a path that includes the non-selected first speech unit 202*f* and the candidate second speech unit 204 is one of the best K paths and use that path to select a third speech unit 206.

FIG. 2 illustrates several significant aspects of the process of building the lattice 200. The lattice generator 120 can build the lattice 200 in a sequential manner, selecting a first set of speech units to represent the first text unit in the lattice 200, then selecting second set of speech units to represent the second text unit in the lattice 200, and so on. The selection of speech units for each text unit may depend on the speech units included in the lattice 200 for previous text units. The lattice generator 120 selects multiple speech units to include in the lattice 200 for each text unit, e.g., L=6 speech units per text unit in the example of FIG. 2.

The lattice generator 120 can select the speech units for the lattice 200 in a manner that continues or builds on the existing best paths through the lattice 200. Rather than continuing a single best path, or only paths that pass through a single speech unit, the lattice generator 120 continues paths through multiple speech units in the lattice for each text unit. The lattice generator 120 may re-run a Viterbi analysis each time a set of speech units are added to the lattice 200. As a result, the specific nature of the paths may change from one selection step to the next.

In FIG. 2, each column includes six speech units, and only three of the speech units in a column are used to determine which speech units to include in the next column. The lattice generator 120 selects a predetermined number of speech units, e.g., units 202*a*-202*c* for the text unit "h-e", that represent the best paths through the lattice 200 to that point. These can be the speech units associated with a lowest total cost. For a particular speech unit in the lattice 200, the total cost can represent the combined join costs and target costs in a best path through the lattice 200 that (i) begins at any speech unit in the lattice 200 representing the initial text unit of the text unit sequence, and (ii) ends at the particular speech unit.

To select speech units for a current text unit, the Viterbi algorithm can be run to determine the best path and associated total cost for each speech unit in the lattice 200 that represents the prior text unit. A predetermined number of speech units with the lowest total path cost, e.g., K=3 in the example of FIG. 2, can be selected as the best K speech units for the prior text unit. Those best K speech units for the prior text unit can be used during the analysis performed to select the speech units to represent the current text unit. Each of the best speech units can be allocated a portion of the limited space in the lattice 200 for the current text unit, e.g., space for L=6 speech units.

For each of the best K speech units for the prior text unit, a predetermined number of speech units can be added to the lattice to represent the current text unit. For example, L/K speech units, e.g., 6/3=2 speech units, can be added for each of the best K speech units for the prior speech unit. For speech unit 202*a*, which is determined to be one of the best K speech units for the text unit "h-e," speech units 204*a* and 204*b* are selected and added, based on their target costs with respect to text unit "e-l" and based on their join costs with respect to speech unit 202*a*. Similarly, for speech unit 202*b*, which is also determined to be one of the best K speech units for the text unit "h-e," speech units 204*c* and 204*d* are selected and added, based on their target costs with respect to text unit "e-l" and based on their join costs with respect to speech unit 202*b*. The first set of speech units 204*a* and 204*b* may be selected according to somewhat different criteria than the second set of speech units 204*c* and 204*d*, since the two sets are determined using join costs with respect to different prior speech units.

The example of FIG. 2 show that for a current column of the lattice 200 being populated, paths through some of the speech units in the previous column are effectively pruned or ignored, and are not used to determine join costs for adding speech units to the current column. In addition, a path through one of the best K speech units in the previous column is branched or split so that two or more speech units in the current column separately continue the path. As a result, the selection process for each text unit effectively branches out the best, lowest-cost paths while limiting computational complexity by restricting the number of candidate speech units for each text unit.

Returning to FIG. 1, when the lattice generator 120 has determined speech units for all of the text units in the sequence of text units, e.g., determined K paths of speech units, the lattice generator 120 provides data for each of the paths to a path selector 122. The path selector 122 analyzes each of the paths to determine a best path. The best path may have a lowest cost when lower cost values represent a closer match between speech units and text units. The best path may have a highest cost when higher values represent a closer match between speech units and text units.

For example, the path selector 122 may analyze each of the K paths generated by the lattice generator 120 and select a path using a target cost, a join cost, or a total cost for the speech units in the path. The path selector 122 may determine a path cost by combining the costs for each of the selected speech units in the path. For instance, when a path includes three speech units, the path selector 122 may determine a sum of the costs used to select each of the three speech units. The costs may be target costs, join costs, or a combination of both. In some examples, the costs may be a combination of two or more of target costs, join costs, or total costs.

In the speech unit lattice 200 shown in FIG. 2, the path selector 122 selects a path that includes SpeechUnit(m−1,1) 202*a*, SpeechUnit(m,2) 204*b*, and SpeechUnit(m+1,2) 206*b* for synthesis of the word "hello", as indicated by the bold lines surrounding and connecting these speech units. The selected speech units may have a lowest path cost or a highest path cost depending on whether lower or higher values indicate a closer match between speech units and text units and between multiple speech units in the same path.

Returning to FIG. 1, the text-to-speech system 116 generates a second communication 136 that identifies synthesized speech data for the selected path. In some implementations, the synthesized speech data may include instructions to cause a device, e.g., a speaker, to generate synthesized speech for the text message.

The text-to-speech system 116 provides the second communication 136 to the user device 102, e.g., using the network 138. The user device 102, e.g., the computer-implemented agent 108, provides an audible presentation 110 of the text message on a speaker 106 using data from the second communication 136. The user device 102 may provide the audible presentation 110 while presenting visible content 114 of the text message in an application user interface 112, e.g., a text message application user interface, on a display.

In some implementations, the sequence of text units may be for a word, a sentence, or a paragraph. For example, the text unit parser 118 may receive data identifying a paragraph and divide the paragraph into sentences. The first sentence may be "Hello, Don" and the second sentence may be "Let's connect on Friday." The text unit parser 118 may provide separate sequences of text units for each of the sentences to the lattice generator 120 to cause the synthesized data selector to generate paths for the each of the sequences of text units separately.

The text unit parser 118, and the text-to-speech system 116, may determine a length of the sequence of text units using a time at which synthesized speech data should be presented, a measure that indicates how likely synthesized speech data behaves as naturally articulated speech, or both. For instance, to cause the speaker 106 to present audible content more quickly, the text unit parser 118 may select shorter sequences of text units so that the text-to-speech system 116 will provide the user device 102 with the second communication 136 more quickly. In these examples, the text-to-speech system 116 may provide the user device 102 with multiple second communications until the text-to-speech system 116 has provided data for the entire text message or other text data. In some examples, the text unit parser 118 may select longer sequences of text units to increase the likelihood that the synthesized speech data behaves like naturally articulated speech.

In some implementations, the computer-implemented agent 108 has predetermined speech synthesis data for one or more predefined messages. For instance, the computer-implemented agent 108 may include predetermined speech synthesis data for the prompt "there is an unread text message for you." In these examples, the computer-implemented agent 108 sends data for the unread text message to the text-to-speech system 116 because the computer-implemented agent 108 does not have predetermined speech synthesis data for the unread text message. For example, the sequence of words and sentences in the unread text message is not the same as any of the predefined messages for the computer-implemented agent 108.

In some implementations, the user device 102 may provide audible presentation of content without the use of the computer-implemented agent 108. For example, the user device 102 may include a text message application or another application that provides the audible presentation of the text message.

The text-to-speech system 116 is an example of a system implemented as computer programs on one or more computers in one or more locations, in which the systems, components, and techniques described in this document are implemented. The user device 102 may include personal computers, mobile communication devices, and other devices that can send and receive data over the network 138. The network 138, such as a local area network (LAN), wide area network (WAN), the Internet, or a combination thereof, connects the user device 102, and the text-to-speech system 116. The text-to-speech system 116 may use a single server computer or multiple server computers operating in conjunction with one another, including, for example, a set of remote computers deployed as a cloud computing service.

Figure 3:
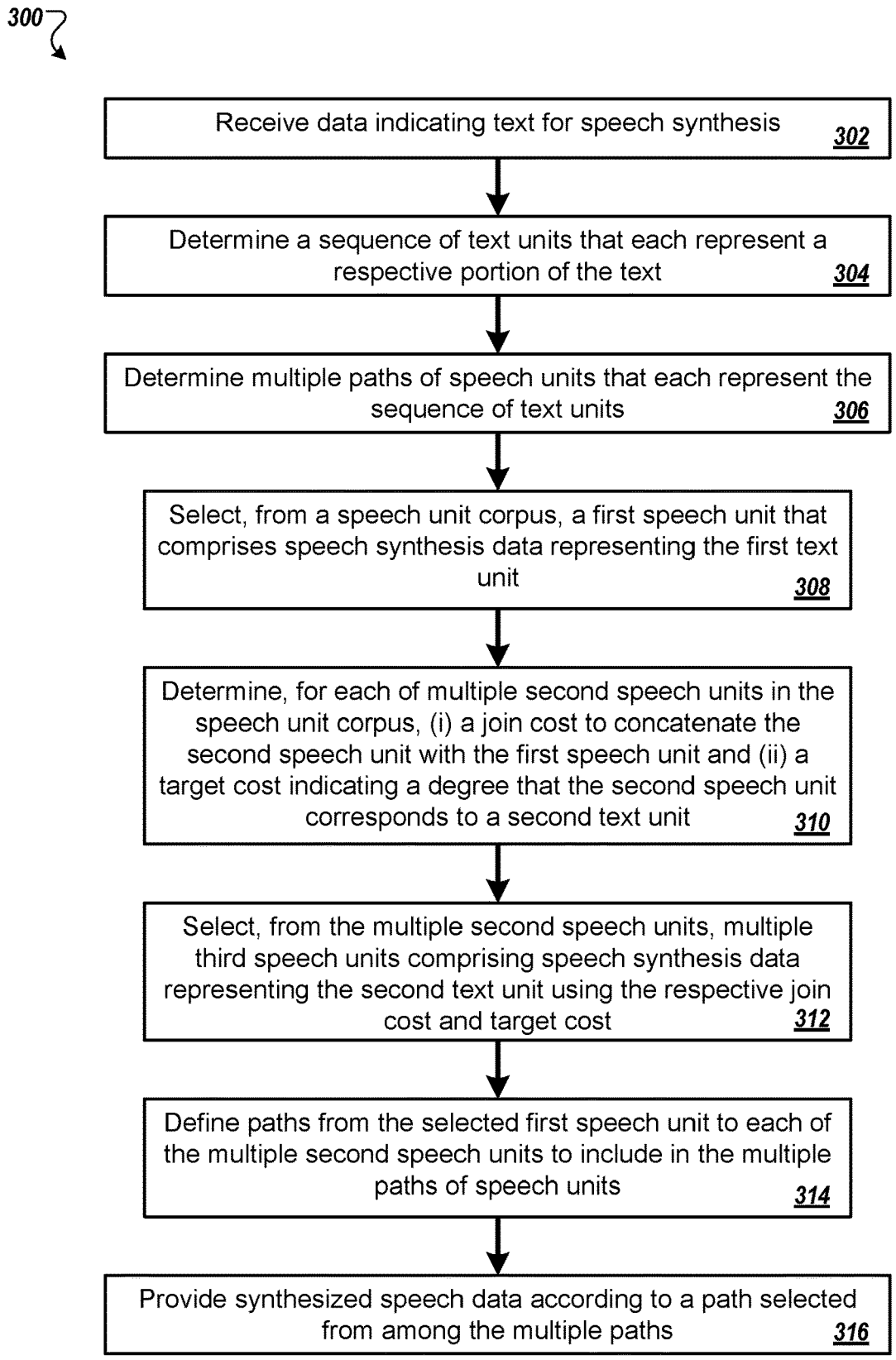
FIG. 3 is a flow diagram of a process for providing synthesized speech data.

FIG. 3 is a flow diagram of a process 300 for providing synthesized speech data. For example, the process 300 can be used by the text-to-speech system 116 from the environment 100.

A text-to-speech system receives data indicating text for speech synthesis (302). For instance, the text-to-speech system receives data from a user device that indicates text from a text message or an email. The data may identify the type of text, such as email or text message, e.g., for use determining synthesis data The text-to-speech system determines a sequence of text units that each represent a respective portion of the text (304). Each of the text units may represent a distinct portion of the text, separate from the portions of text represented by the other text units. The text-to-speech system may determine a sequence of text units for all of the received text. In some examples, the text-to-speech system may determine a sequence of text units for a portion of the received text.

The text-to-speech system determines multiple paths of speech units that each represent the sequence of text units (306). For example, the text-to-speech system may perform one or more of steps 308 through 314 to determine the paths of speech units.

The text-to-speech system selects, from a speech unit corpus, a first speech unit that comprises speech synthesis data representing the first text unit (308). The first text unit may have a location at the beginning of the sequence of text units. In some examples, the first text unit may have a different location in the sequence of text units other than the last location in the sequence of text units. In some examples, the text-to-speech system may select two or more first speech units that each comprise different speech synthesis data representing the first text unit.

The text-to-speech system determines, for each of multiple second speech units in the speech unit corpus, (i) a join cost to concatenate the second speech unit with the first speech unit and (ii) a target cost indicating a degree that the second speech unit corresponds to a second text unit (310). The second text unit may have a second location in the sequence of text units that is subsequent to the location for the first text unit without any intervening locations in the sequence of text units. In some implementations, the text-to-speech system may determine a join cost to concatenate the second speech unit with the first speech unit and one or more additional speech units in the path, e.g., including a beginning speech unit in the path that is a different speech unit than the first speech unit.

The text-to-speech system may determine first acoustic parameters for each selected speech unit in the path. The text-to-speech system may determine first linguistic parameters for the second text unit. The text-to-speech system may determine a target composite vector that includes data for the first acoustic parameters and the first linguistic parameters. The text-to-speech system only needs to determine the first acoustic parameters, the first linguistic parameters, and the target composite vector once for the group of multiple second speech units. In some examples, the text-to-speech system may determine the first acoustic parameters, the first linguistic parameters, and the target vector separately for each second speech unit.

The text-to-speech system may determine a respective join cost for a particular second speech unit using the first acoustic parameters and second acoustic parameters for the particular second speech unit. The text-to-speech system may determine a respective target cost for a particular second speech unit using the first linguistic parameters and second linguistic parameters for the particular second speech unit. When the text-to-speech system determines both a join cost and a target cost for a particular second speech unit, the text-to-speech system may determine only a total cost for the particular second speech unit that represents both the join cost and the target cost for adding the particular second speech unit to a path.

In some implementations, the text-to-speech system may determine one or more costs for multiple second speech units concurrently. For instance, the text-to-speech may concurrently determine, for each of two or more second speech units, the join cost and the target costs, e.g., as separate costs or a single target cost, for the respective second speech unit.

The text-to-speech system selects, from the multiple second speech units, multiple third speech units comprising speech synthesis data representing the second text unit using the respective join cost and target cost (312). For example, the text-to-speech system may determine the best K second speech units. The text-to-speech system may compare the cost for each of the second speech units with the costs for the other second speech units to determine the best K second speech units.

The text-to-speech system defines paths from the selected first speech unit to each of the multiple second speech units to include in the multiple paths of speech units (314). The text-to-speech system may generate K paths using the determined best K second speech units where each of the best K second speech units is a last speech unit for the respective path.

The text-to-speech system provides synthesized speech data according to a path selected from among the multiple paths (316). Providing the synthesized speech data to a device may cause the device to generate an audible presentation of the synthesized speech data that corresponds to all or part of the received text.

In some implementations, the process 300 can include additional steps, fewer steps, or some of the steps can be divided into multiple steps. For example, the text-to-speech system may perform steps 302 through 304, and 310 through 314 without performing steps 306, 308, or 316.

Embodiments of the subject matter and the functional operations described in this specification can be implemented in digital electronic circuitry, in tangibly-embodied computer software or firmware, in computer hardware, including the structures disclosed in this specification and their structural equivalents, or in combinations of one or more of them. Embodiments of the subject matter described in this specification can be implemented as one or more computer programs, i.e., one or more modules of computer program instructions encoded on a tangible non-transitory program carrier for execution by, or to control the operation of, data processing apparatus. Alternatively or in addition, the program instructions can be encoded on an artificially-generated propagated signal, e.g., a machine-generated electrical, optical, or electromagnetic signal, that is generated to encode information for transmission to suitable receiver apparatus for execution by a data processing apparatus. The computer storage medium can be a machine-readable storage device, a machine-readable storage substrate, a random or serial access memory device, or a combination of one or more of them.

The term "data processing apparatus" refers to data processing hardware and encompasses all kinds of apparatus, devices, and machines for processing data, including by way of example a programmable processor, a computer, or multiple processors or computers. The apparatus can also be or further include special purpose logic circuitry, e.g., an FPGA (field programmable gate array) or an ASIC (application-specific integrated circuit). The apparatus can optionally include, in addition to hardware, code that creates an execution environment for computer programs, e.g., code that constitutes processor firmware, a protocol stack, a database management system, an operating system, or a combination of one or more of them.

A computer program, which may also be referred to or described as a program, software, a software application, a module, a software module, a script, or code, can be written in any form of programming language, including compiled or interpreted languages, or declarative or procedural languages, and it can be deployed in any form, including as a stand-alone program or as a module, component, subroutine, or other unit suitable for use in a computing environment. A computer program may, but need not, correspond to a file in a file system. A program can be stored in a portion of a file that holds other programs or data, e.g., one or more scripts stored in a markup language document, in a single file dedicated to the program in question, or in multiple coordinated files, e.g., files that store one or more modules, sub-programs, or portions of code. A computer program can be deployed to be executed on one computer or on multiple computers that are located at one site or distributed across multiple sites and interconnected by a communication network.

The processes and logic flows described in this specification can be performed by one or more programmable computers executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application-specific integrated circuit).

Computers suitable for the execution of a computer program include, by way of example, general or special purpose microprocessors or both, or any other kind of central processing unit. Generally, a central processing unit will receive instructions and data from a read-only memory or a random access memory or both. The essential elements of a computer are a central processing unit for performing or executing instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a smart phone, a personal digital assistant (PDA), a mobile audio or video player, a game console, a Global Positioning System (GPS) receiver, or a portable storage device, e.g., a universal serial bus (USB) flash drive, to name just a few.

Computer-readable media suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, embodiments of the subject matter described in this specification can be implemented on a computer having a display device, e.g., LCD (liquid crystal display), OLED (organic light emitting diode) or other monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's device in response to requests received from the web browser.

Embodiments of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an implementation of the subject matter described in this specification, or any combination of one or more such back-end, middleware, or front-end components. The components of the system can be interconnected by any form or medium of digital data communication, e.g., a communication network. Examples of communication networks include a local area network (LAN) and a wide area network (WAN), e.g., the Internet.

The computing system can include clients and servers. A client and server are generally remote from each other and typically interact through a communication network. The relationship of client and server arises by virtue of computer programs running on the respective computers and having a client-server relationship to each other. In some embodiments, a server transmits data, e.g., an HyperText Markup Language (HTML) page, to a user device, e.g., for purposes of displaying data to and receiving user input from a user interacting with the user device, which acts as a client. Data generated at the user device, e.g., a result of the user interaction, can be received from the user device at the server.

Figure 4:
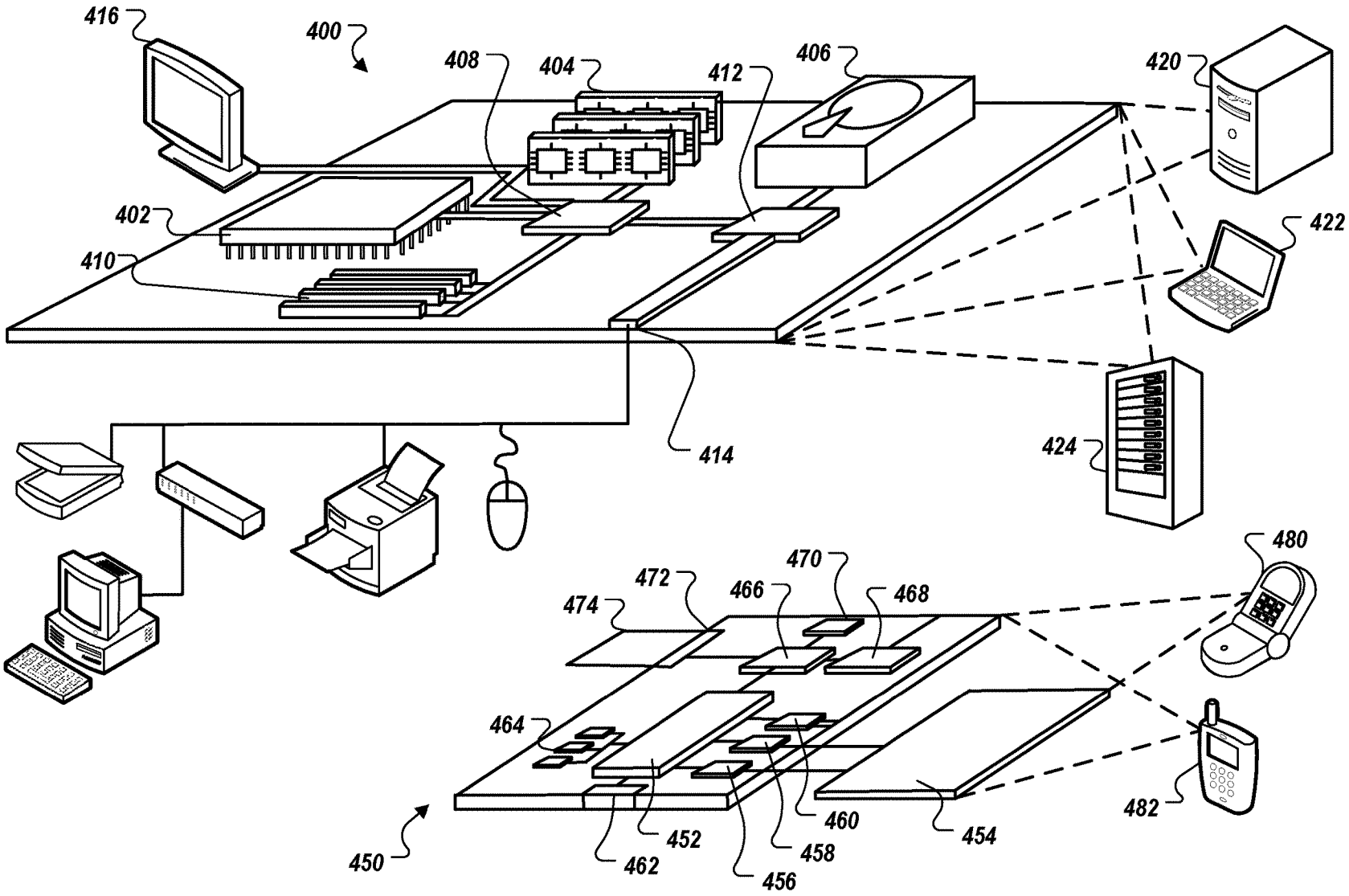
FIG. 4 is a block diagram of a computing system that can be used in connection with computer-implemented methods described in this document.

FIG. 4 is a block diagram of computing devices 400, 450 that may be used to implement the systems and methods described in this document, as either a client or as a server or plurality of servers. Computing device 400 is intended to represent various forms of digital computers, such as laptops, desktops, workstations, personal digital assistants, servers, blade servers, mainframes, and other appropriate computers. Computing device 450 is intended to represent various forms of mobile devices, such as personal digital assistants, cellular telephones, smartphones, smartwatches, head-worn devices, and other similar computing devices. The components shown here, their connections and relationships, and their functions, are meant to be exemplary only, and are not meant to limit implementations described and/or claimed in this document.

Computing device 400 includes a processor 402, memory 404, a storage device 406, a high-speed interface 408 connecting to memory 404 and high-speed expansion ports 410, and a low speed interface 412 connecting to low speed bus 414 and storage device 406. Each of the components 402, 404, 406, 408, 410, and 412, are interconnected using various busses, and may be mounted on a common motherboard or in other manners as appropriate. The processor 402 can process instructions for execution within the computing device 400, including instructions stored in the memory 404 or on the storage device 406 to display graphical information for a GUI on an external input/output device, such as display 416 coupled to high speed interface 408. In other implementations, multiple processors and/or multiple buses may be used, as appropriate, along with multiple memories and types of memory. Also, multiple computing devices 400 may be connected, with each device providing portions of the necessary operations (e.g., as a server bank, a group of blade servers, or a multi-processor system).

The memory 404 stores information within the computing device 400. In one implementation, the memory 404 is a computer-readable medium. In one implementation, the memory 404 is a volatile memory unit or units. In another implementation, the memory 404 is a non-volatile memory unit or units.

The storage device 406 is capable of providing mass storage for the computing device 400. In one implementation, the storage device 406 is a computer-readable medium. In various different implementations, the storage device 406 may be a floppy disk device, a hard disk device, an optical disk device, or a tape device, a flash memory or other similar solid state memory device, or an array of devices, including devices in a storage area network or other configurations. In one implementation, a computer program product is tangibly embodied in an information carrier. The computer program product contains instructions that, when executed, perform one or more methods, such as those described above. The information carrier is a computer- or machine-readable medium, such as the memory 404, the storage device 406, or memory on processor 402.

The high speed controller 408 manages bandwidth-intensive operations for the computing device 400, while the low speed controller 412 manages lower bandwidth-intensive operations. Such allocation of duties is exemplary only. In one implementation, the high-speed controller 408 is coupled to memory 404, display 416 (e.g., through a graphics processor or accelerator), and to high-speed expansion ports 410, which may accept various expansion cards (not shown). In the implementation, low-speed controller 412 is coupled to storage device 406 and low-speed expansion port 414. The low-speed expansion port, which may include various communication ports (e.g., USB, Bluetooth, Ethernet, wireless Ethernet) may be coupled to one or more input/output devices, such as a keyboard, a pointing device, a scanner, or a networking device such as a switch or router, e.g., through a network adapter.

The computing device 400 may be implemented in a number of different forms, as shown in the figure. For example, it may be implemented as a standard server 420, or multiple times in a group of such servers. It may also be implemented as part of a rack server system 424. In addition, it may be implemented in a personal computer such as a laptop computer 422. Alternatively, components from computing device 400 may be combined with other components in a mobile device (not shown), such as device 450. Each of such devices may contain one or more of computing device 400, 450, and an entire system may be made up of multiple computing devices 400, 450 communicating with each other.

Computing device 450 includes a processor 452, memory 464, an input/output device such as a display 454, a communication interface 466, and a transceiver 468, among other components. The device 450 may also be provided with a storage device, such as a microdrive or other device, to provide additional storage. Each of the components 450, 452, 464, 454, 466, and 468, are interconnected using various buses, and several of the components may be mounted on a common motherboard or in other manners as appropriate.

The processor 452 can process instructions for execution within the computing device 450, including instructions stored in the memory 464. The processor may also include separate analog and digital processors. The processor may provide, for example, for coordination of the other components of the device 450, such as control of user interfaces, applications run by device 450, and wireless communication by device 450.

Processor 452 may communicate with a user through control interface 458 and display interface 456 coupled to a display 454. The display 454 may be, for example, a TFT LCD display or an OLED display, or other appropriate display technology. The display interface 456 may comprise appropriate circuitry for driving the display 454 to present graphical and other information to a user. The control interface 458 may receive commands from a user and convert them for submission to the processor 452. In addition, an external interface 462 may be provided in communication with processor 452, so as to enable near area communication of device 450 with other devices. External interface 462 may provide, for example, for wired communication (e.g., via a docking procedure) or for wireless communication (e.g., via Bluetooth or other such technologies).

The memory 464 stores information within the computing device 450. In one implementation, the memory 464 is a computer-readable medium. In one implementation, the memory 464 is a volatile memory unit or units. In another implementation, the memory 464 is a non-volatile memory unit or units. Expansion memory 474 may also be provided and connected to device 450 through expansion interface 472, which may include, for example, a SIMM card interface. Such expansion memory 474 may provide extra storage space for device 450, or may also store applications or other information for device 450. Specifically, expansion memory 474 may include instructions to carry out or supplement the processes described above, and may include secure information also. Thus, for example, expansion memory 474 may be provided as a security module for device 450, and may be programmed with instructions that permit secure use of device 450. In addition, secure applications may be provided via the SIMM cards, along with additional information, such as placing identifying information on the SIMM card in a non-hackable manner.

The memory may include for example, flash memory and/or MRAM memory, as discussed below. In one implementation, a computer program product is tangibly embodied in an information carrier. The computer program product contains instructions that, when executed, perform one or more methods, such as those described above. The information carrier is a computer- or machine-readable medium, such as the memory 464, expansion memory 474, or memory on processor 452.

Device 450 may communicate wirelessly through communication interface 466, which may include digital signal processing circuitry where necessary. Communication interface 466 may provide for communications under various modes or protocols, such as GSM voice calls, SMS, EMS, or MMS messaging, CDMA, TDMA, PDC, WCDMA, CDMA2020, or GPRS, among others. Such communication may occur, for example, through radio-frequency transceiver 468. In addition, short-range communication may occur, such as using a Bluetooth, WiFi, or other such transceiver (not shown). In addition, GPS receiver module 470 may provide additional wireless data to device 450, which may be used as appropriate by applications running on device 450.

Device 450 may also communicate audibly using audio codec 460, which may receive spoken information from a user and convert it to usable digital information. Audio codec 460 may likewise generate audible sound for a user, such as through a speaker, e.g., in a handset of device 450. Such sound may include sound from voice telephone calls, may include recorded sound (e.g., voice messages, music files, etc.) and may also include sound generated by applications operating on device 450.

The computing device 450 may be implemented in a number of different forms, as shown in the figure. For example, it may be implemented as a cellular telephone 480. It may also be implemented as part of a smartphone 482, personal digital assistant, or other similar mobile device.

Various implementations of the systems and techniques described here can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms "machine-readable medium" "computer-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

To provide for interaction with a user, the systems and techniques described here can be implemented on a computer having a display device (e.g., a CRT (cathode ray tube) or LCD (liquid crystal display) monitor) for displaying information to the user and a keyboard and a pointing device (e.g., a mouse or a trackball) by which the user can provide input to the computer. Other kinds of devices can be used to provide for interaction with a user as well; for example, feedback provided to the user can be any form of sensory feedback (e.g., visual feedback, auditory feedback, or tactile feedback); and input from the user can be received in any form, including acoustic, speech, or tactile input.

The systems and techniques described here can be implemented in a computing system that includes a back end component (e.g., as a data server), or that includes a middleware component (e.g., an application server), or that includes a front end component (e.g., a client computer having a graphical user interface or a Web browser through which a user can interact with an implementation of the systems and techniques described here), or any combination of such back end, middleware, or front end components. The components of the system can be interconnected by any form or medium of digital data communication (e.g., a communication network). Examples of communication networks include a local area network ("LAN"), a wide area network ("WAN"), and the Internet.

The computing system can include clients and servers. A client and server are generally remote from each other and typically interact through a communication network. The relationship of client and server arises by virtue of computer programs running on the respective computers and having a client-server relationship to each other.

While this specification contains many specific implementation details, these should not be construed as limitations on the scope of what may be claimed, but rather as descriptions of features that may be specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system modules and components in the embodiments described above should not be understood as requiring such separation in all embodiments, and it should be understood that the described program components and systems can generally be integrated together in a single software product or packaged into multiple software products.

Particular embodiments of the subject matter have been described. Other embodiments are within the scope of the following claims. For example, the actions recited in the claims can be performed in a different order and still achieve desirable results. As one example, the processes depicted in the accompanying figures do not necessarily require the particular order shown, or sequential order, to achieve desirable results. In some cases, multitasking and parallel processing may be advantageous.

What is claimed is:

1. One or more non-transitory computer storage media encoded with instructions that, when executed by one or more computers of a text-to-speech system, cause the one or more computers to perform operations comprising:

receiving, by the one or more computers of the text-to-speech system, data indicating text for speech synthesis;

determining, by the one or more computers of the text-to-speech system, a sequence of text units that each represent a respective portion of the text, the sequence of text units including at least a first text unit followed by a second text unit;

generating, by the one or more computers of the text-to-speech system, a lattice of candidate speech units comprising a same predetermined L number of speech units for each of the text units in the sequence of text units, each speech unit in the lattice of candidate speech units associated with respective acoustic parameters, wherein the lattice is generated by adding, to the lattice, speech units that are each selected to extend one of multiple specific paths through the lattice, wherein only a limited quantity of specific paths through the lattice are extended, and wherein the speech units added to the lattice to extend the multiple specific paths are each selected based on:

a join cost to concatenate the added speech unit with a last speech unit of the specific path that the added speech unit is selected to extend based on the respective acoustic parameters associated with the added speech unit, the respective acoustic parameters comprising a speech unit context indicating at least one of an adjacent speech unit that occurred before the added speech unit when a waveform associated with the added speech unit was created or an adjacent speech unit that occurred after the added speech unit when the waveform associated with the added speech unit was created; and a target cost indicating a degree that the added speech unit corresponds to the text unit to which the added speech unit corresponds in the lattice; and providing, by the one or more computers of the text-to-speech system, synthesized speech data according to a path of speech units through the generated lattice, wherein the multiple specific paths through the lattice comprise K number of paths, and wherein adding speech units to the lattice comprises, for the last speech unit of each of the K number paths:

determining X number of speech units to extend from the last speech unit of the corresponding specific path of the K number of paths, wherein X corresponds to a value represented by a ratio of L to K; and adding the determined X number of speech units to the last speech unit of the corresponding specific path of the K number of paths.

2. The non-transitory computer storage media of claim 1, wherein determining the sequence of text units that each represent a respective portion of the text comprises determining the sequence of text units that each represent a distinct portion of the text, separate from the portions of text represented by the other text units.

3. A text-to-speech system comprising one or more computers and one or more storage devices on which are stored instructions that are operable, when executed by the one or more computers, to cause the one or more computers to perform operations comprising:

receiving, by the one or more computers of the text-to-speech system, data indicating text for speech synthesis;

determining, by the one or more computers of the text-to-speech system, a sequence of text units that each represent a respective portion of the text, the sequence of text units including at least a first text unit followed by a second text unit;

generating, by the one or more computers of the text-to-speech system, a lattice of candidate speech units comprising a same predetermined L number of speech units for each of the text units in the sequence of text units, each speech unit in the lattice of candidate speech units associated with respective acoustic parameters, wherein the lattice is generated by adding, to the lattice, speech units that are each selected to extend one of multiple specific paths through the lattice, wherein only a limited quantity of specific paths through the lattice are extended, and wherein the speech units added to the lattice to extend the multiple specific paths are each selected based on:

a join cost to concatenate the added speech unit with a last speech unit of the specific path that the added speech unit is selected to extend based on the respective acoustic parameters associated with the added speech unit, the respective acoustic parameters comprising a speech unit context indicating at least one of an adjacent speech unit that occurred before the added speech unit when a waveform associated with the added speech unit was created or an adjacent speech unit that occurred after the added speech unit when the waveform associated with the added speech unit was created; and a target cost indicating a degree that the added speech unit corresponds to the text unit to which the added speech unit corresponds in the lattice; and providing, by the one or more computers of the text-to-speech system, synthesized speech data according to a path of speech units through the generated lattice, wherein the multiple specific paths through the lattice comprise K number of paths, and wherein adding speech units to the lattice comprises, for the last speech unit of each of the K number of paths;

determining X number of speech units to extend from the last speech unit of the corresponding specific path of the K number of paths, wherein X corresponds to a value represented by a ratio of L to K; and adding the determined X number of speech units to the last speech unit of the corresponding specific path of the K number of paths.

4. The text-to-speech system of claim 3, wherein determining the sequence of text units that each represent a respective portion of the text comprises determining the sequence of text units that each represent a distinct portion of the text, separate from the portions of text represented by the other text units.

5. The text-to-speech system of claim 3, wherein providing the synthesized speech data according to the path selected from among the multiple paths comprises providing the synthesized speech data to cause a device to generate audible data for the text.

6. The text-to-speech system of claim 3, wherein generating the lattice comprises:

selecting, from a speech unit corpus, the same predetermined L number of beginning speech units that each comprise speech synthesis data representing a beginning text unit in the sequence of text units with a location at a beginning of the text; and extending a specific path through the lattice from each of multiple of the predetermined L number of beginning speech units.

7. The text-to-speech system of claim 6, wherein generating the lattice comprises extending a predetermined number of paths from the predetermined L number of beginning speech units.

8. A computer-implemented method comprising:

receiving, by the one or more computers of the text-to-speech system, data indicating text for speech synthesis;

determining, by the one or more computers of the text-to-speech system, a sequence of text units that each represent a respective portion of the text, the sequence of text units including at least a first text unit followed by a second text unit;

generating, by the one or more computers of the text-to-speech system, a lattice of candidate speech units comprising a same predetermined L number of speech units for each of the text units in the sequence of text units, each speech unit in the lattice of candidate speech units associated with respective acoustic parameters, wherein the lattice is generated by adding, to the lattice, speech units that are each selected to extend one of multiple specific paths through the lattice, wherein only a limited quantity of specific paths through the lattice are extended, and wherein the speech units added to the lattice to extend the multiple specific paths are each selected based on:

a join cost to concatenate the added speech unit with a last speech unit of the specific path that the added speech unit is selected to extend based on the respective acoustic parameters associated with the added speech unit, the respective acoustic parameters comprising a speech unit context indicating at least one of an adjacent speech unit that occurred before the added speech unit when a waveform associated with the added speech unit was created or an adjacent speech unit that occurred after the added speech unit when the waveform associated with the added speech unit was created; and a target cost indicating a degree that the added speech unit corresponds to the text unit to which the added speech unit corresponds in the lattice; and providing, by the one or more computers of the text-to-speech system, synthesized speech data according to a path of speech units through the generated lattice, wherein the multiple specific paths through the lattice comprise K number of paths, and wherein adding speech units to the lattice comprises, for the last speech unit of each of the K number of paths;

determining X number of speech units to extend from the last speech unit of the corresponding specific path of the K number of paths, wherein X corresponds to a value represented by a ratio of L to K; and adding X number of speech units to each of the K number of paths, wherein X corresponds to a value represented by a ratio of L to K.

9. The method of claim 8, wherein the same predetermined L number of speech units are selected to be added to the speech lattice further based on a total path cost for the respective multiple specific paths, wherein the total path cost for each specific path includes join costs and target costs for all speech units in the specific path.

10. The method of claim 8, wherein generating the lattice comprises selecting, for each particular text unit of multiple text units in the sequence of text units, a set of speech units based on only a limited number of specific paths through the lattice up to a position in the lattice corresponding to the particular text unit.

11. The method of claim 8, wherein generating the lattice comprises selecting, for each particular text unit of multiple text units in the sequence of text units, a set of speech units based on a predetermined number of paths through the lattice up to the position in the lattice corresponding to the particular text unit.

12. The method of claim 8, wherein generating the lattice comprises sequentially populating the lattice with speech units for the respective text units, and continuing no more than a predetermined maximum number of specific paths for each of the text units.

13. The method of claim 8, wherein generating the lattice comprises sequentially selecting sets of speech units for the respective text units in the sequence of text units, wherein selecting the set of speech units for a text unit comprises selecting, for the position in the lattice corresponding to the text unit, (i) one or more of the multiple paths to branch into multiple paths and (ii) one or more of the multiple paths to prune.

14. The method of claim 8, wherein generating the lattice comprises, at positions in the lattice corresponding to each of multiple different text units in the sequence of text units:

identifying, from among the multiple specific paths continued up to a current position in the lattice, one or more specific paths having the lowest total path cost, wherein the total path cost for a specific path includes join costs and target costs for all speech units in the specific path;

branching a path, selected from among the multiple paths, that is determined to have a lowest total path cost through the lattice among the multiple paths; and pruning one or more of the multiple specific paths such that a predetermined number of specific paths is extended for a next position in the lattice.

15. The method of claim 8, wherein generating the lattice comprises determining a subset of the specific paths to branch into multiple paths based on a total cost that includes join costs and target costs for a sequence of three or more speech units.

* * * * *